US012325888B2

(12) United States Patent
Puukko et al.

(10) Patent No.: US 12,325,888 B2
(45) Date of Patent: Jun. 10, 2025

(54) METHOD FOR MANUFACTURING OF STAINLESS STEEL STRIPS

(71) Applicant: Outokumpu Oyj, Helsinki (FI)

(72) Inventors: Esa Puukko, Tornio (FI); Leeni Aula, Keminmaa (FI)

(73) Assignee: Outokumpu Oyj, Helsinki (FI)

( * ) Notice: Subject to any disclaimer, the term of this patent is extended or adjusted under 35 U.S.C. 154(b) by 611 days.

(21) Appl. No.: 17/310,291

(22) PCT Filed: Jan. 24, 2020

(86) PCT No.: PCT/FI2020/050037
§ 371 (c)(1),
(2) Date: Jul. 27, 2021

(87) PCT Pub. No.: WO2020/157377
PCT Pub. Date: Aug. 6, 2020

(65) Prior Publication Data

US 2022/0177989 A1 Jun. 9, 2022

(30) Foreign Application Priority Data

Jan. 28, 2019 (FI) ..... 20195052

(51) Int. Cl.
*C21D 8/02* (2006.01)
*B21B 1/26* (2006.01)
(Continued)

(52) U.S. Cl.
CPC ..... *C21D 8/0226* (2013.01); *B21B 1/26* (2013.01); *B21B 1/28* (2013.01); *B21B 45/06* (2013.01);
(Continued)

(58) Field of Classification Search
CPC .... B21B 1/26; B21B 1/28; B21B 3/02; B21B 45/06; C21D 1/02; C21D 2211/001;
(Continued)

(56) References Cited

U.S. PATENT DOCUMENTS 3,776,784 A * 12/1973 Rowe ..... C21D 8/0205 148/610
5,197,179 A 3/1993 Sendzimir
(Continued)

FOREIGN PATENT DOCUMENTS

EP 0738781 A1 10/1996
EP 837147 A2 * 4/1998 ..... C21D 8/0205
(Continued)

*Primary Examiner* — Jenny R Wu
(74) *Attorney, Agent, or Firm* — The Webb Law Firm

(57) ABSTRACT

The invention relates to a method for manufacturing strips of stainless steel, comprising hot rolling in an initial process (A) and subsequently cold rolling in a cold rolling line (B). The hot rolling is stopped when the strip thickness has been reduced to a thickness between 2.0 mm and 6.5 mm. The subsequent cold rolling is passed at least one time through said cold rolling line, which comprises in the following order: At least one cold rolling mill (11-13) in the initial part of the line, at least one annealing section (17), a scale breaking step (21), a shot blasting step (23) and at least one pickling section (26, 27) utilizing a mixture of nitric acid $HNO_3$, hydrofluoric acid HF and optionally sulphuric acid $H_2SO_4$.

10 Claims, 2 Drawing Sheets

(51) Int. Cl.

| | |
|---|---|
| ***B21B 1/28*** | (2006.01) |
| ***B21B 45/06*** | (2006.01) |
| ***C21D 9/52*** | (2006.01) |
| ***C23G 1/08*** | (2006.01) |
| ***C25F 1/06*** | (2006.01) |

(52) U.S. Cl.
CPC ..... *C21D 8/0205* (2013.01); *C21D 8/0236* (2013.01); *C21D 9/52* (2013.01); *C23G 1/081* (2013.01); *C23G 1/085* (2013.01); *C23G 1/086* (2013.01); *C25F 1/06* (2013.01)

(58) Field of Classification Search
CPC .. C21D 2211/005; C21D 6/002; C21D 6/004; C21D 8/0205; C21D 8/0226; C21D 8/0236; C21D 8/0242; C21D 8/0263; C21D 8/0268; C21D 8/0273; C21D 8/0278; C21D 9/46; C21D 9/52; C21D 9/573; C22C 38/40; C23G 1/081; C23G 1/085; C23G 1/086; C25F 1/06
See application file for complete search history.

(56) References Cited

U.S. PATENT DOCUMENTS

| | | | | |
|---|---|---|---|---|
| 5,554,235 | A | 9/1996 | Noe et al. | |
| 6,546,771 | B1 * | 4/2003 | Ljungars | B21B 1/28 72/200 |

FOREIGN PATENT DOCUMENTS

| | | | | |
|---|---|---|---|---|
| EP | 1637243 | A2 | 3/2006 | |
| EP | 3296032 | A1 * | 3/2018 | B21B 1/28 |

* cited by examiner

METHOD FOR MANUFACTURING OF STAINLESS STEEL STRIPS

TECHNICAL FIELD

The invention relates to a method for manufacturing of strips of stainless steel, comprising rolling in cold condition of strips which in a foregoing process have been manufactured through strip casting and/or have been hot rolled. The invention also relates to a rolling mill line to be used at the carrying out of the method.

BACKGROUND OF THE INVENTION

Cold rolling of stainless steel strips is performed for one or several purposes. The basic purpose is generally to reduce the thickness of the starting strips, which normally have been hot rolled in a foregoing hot rolling line to a thickness of the hot rolled strips, which is not less than 1.5 mm and normally is in the order of 2-6 mm, but can be up to 10 mm. Conventionally, initial annealing, cooling, and descaling shot-blasting as well as pickling in one or more steps precede the cold rolling, for the achievement of a starting material for the cold rolling without oxides and scale residues from the foregoing hot rolling. As an alternative the hot rolling can completely or partly be replaced by manufacturing of strips through casting, which strips may have a thickness down to what is normal for hot rolled strips or be a few millimetres thicker, but also in this case the cold rolling normally is preceded by initial annealing, cooling, descaling shot-blasting, and pickling, to the extent the technique has been implemented at all. At the cold rolling, which conventionally is carried out in a plurality of consecutive cold rolling operations, possibly alternating with annealing, cooling, descaling, and pickling operations, the thickness can be reduced down to 1 mm or even thinner gauges. At the same time it is possible to produce, in these conventional cold rolling mills, strips with a very fine surface, a so called 2B-surface, if the rolling is finished by heat treatment, pickling, and skin-pass-rolling, or even finer (BA-surface) if bright annealing is employed. A cold rolling also may have as a main purpose or as an additional purpose to increase the strength of the strip material. For this purpose is has also been suggested, as a complement to cold rolling—EP 0 738 781—to cold stretch the strip subsequent to annealing, so that the strip is plasticised and is elongated permanently, at the same time as its thickness is reduced. Further is it known—U.S. Pat. No. 5,197,179 and EP 0 837 147—to perform at least a first cold rolling operation on the cooled hot rolled strip or on the cooled cast strip prior to heat treatment, pickling, and possible further cold rolling operations in order to bring the strip to desired final gauge. It is, however, characteristic for methods and rolling mill lines known so far that they are expensive and/or difficult to adapt to widely disparate requirements as far as strip thickness, surface conditions, and strength of the final product are concerned. This particularly applies when hot rolling and subsequent cold rolling, as well as operations in connection with the hot rolling and the cold rolling are considered as an integrated process of production.

In EP 1 637 243 is disclosed a method for manufacturing stainless steel strips, comprising hot rolling to a specified thickness and subsequent cold rolling to a smaller thickness, whereby the process comprises annealing and pickling as well as two passes through the cold rolling line.

DISCLOSURE OF THE INVENTION

It is a purpose of the invention to attack and solve the above complex of problems. This, according a first aspect of the invention, can be achieved a method with the features according to claim 1 in combination.

As has been mentioned in the foregoing description of the background of the invention, it is conventional to hot roll strips to a final hot rolled strip gauge of 2-6 mm and it may even occur that hot rolling is made all the way down to 1.5 mm. The most complicated part of the hot rolling is the final part, i.e. when one is operating with considerably thin strips. This phase is difficult to control and there are also produced much oxides on the strips in relation to the strip thickness. Further, the yield in production in the hot rolling mill is reduced the more the strip thickness is reduced. In order further to improve the starting material used for the subsequent cold rolling it is also advantageous to quench-cool the strip from the final rolling temperature down to below 700° C. in order to avoid the mechanical stress during the coiling and unflatness of hot strips and above all to raise the reability during the process run on the one hand to produce as thin oxides layers as possible and on the other hand to avoid precipitation of grain boundary carbides in the surface layers. In accordance with another aspect of the invention it is the purpose to integrate the initial hot rolling and treatment of the strip in connection with the hot rolling with the subsequent cold rolling in such a mode that there is achieved a good production economy from an overall point of view, with an improved capacity in the hot rolling mill including less risk of bottle necks in the hot rolling mill line, as well as a final product after cold rolling which can satisfy high requirements as far as good quality is concerned. According to this aspect of the invention, the invention relates to a method for manufacturing strips of stainless steel, comprising hot rolling in an initial process and subsequently cold rolling in a rolling mill line, characterised in that the hot rolling is stopped when the strip thickness has been reduced to a thickness between 2.0 and 6.5 mm, preferably to between 3 and 5 mm, that the thus hot rolled strip is cooled from the final hot rolling temperature through quenching to below 700° C., that it at the subsequent cold rolling is passed at least once through said cold rolling line which comprises at least one cold rolling mill in the initial part of the line, and after said initial cold rolling mill/mills at least one annealing section and at least one pickling section, said strip, as it for the first time is passing the at least one cold rolling mill in the initial part of the line, being rolled with the dark coloured oxides which the strip has obtained in the hot condition of the strip during the initial process.

At the initial, and optionally only cold rolling of the stainless steel, when the dark coloured oxidic coatings on both sides of the strip steel are there, which oxidic coatings have been formed in connection with the initial process in the hot state of the steel, a crackling of the oxide scales will occur to some degree. This can be considered as an initial descaling operation, which can facilitate the efficient descaling that is performed later, after the annealing, before the strip is pickled. In order that the said initial crackling shall be possible to be utilised efficiently in order to facilitate later descaling and pickling it is desirable that it as far as possible is not eliminated in connection with the annealing, i.e. so that fissures or cracks in the oxide layers do not heal up at the annealing.

According to the invention, following the annealing a descaling step is carried out followed by a scale-breaker and shot blastingstep.

According to the invention, subsequent to the shot blasting step the steel is subjected to a pickling step using the combination of nitric, hydrofluoric and optionally sulphuric acid.

Elongation target of scale-breaker will be set so that flatness error after cooling section (I) will disappear and thus, strip has no flatness error before shot-blasting to guarantee maximum shot-blasting efficiency.

Required elongation could be calculated as follows:

$$\text{Elongation(scale-breaker) [\%]=elongation at yield point of material [\%]}+I/10000\text{[\%] where,} \quad (1)$$

I=flatness error defined by I-unit,

I—unit is a common way to define height/wavelength relation of flatness error.

Further characteristics and aspects of the invention will be apparent from the accompanying patent claims and from the following description of said rolling mill line and of how the invention can be reduced to practice according to a preferred embodiment.

DETAILED DESCRIPTION OF THE INVENTION

Figure 1:
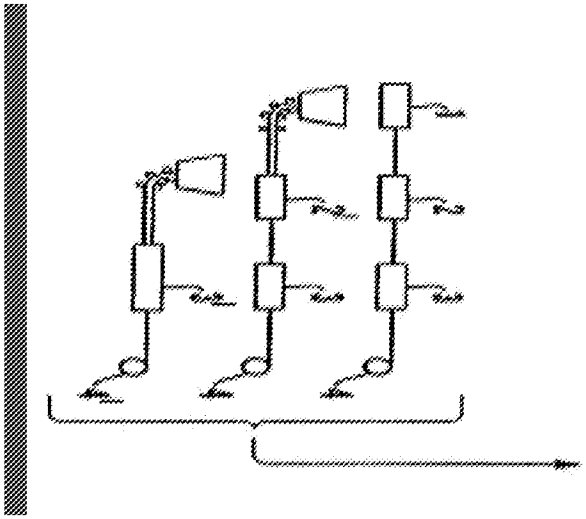
FIG. 1 illustrates an embodiment of the present invention and the rolling mill line semi-schematically, and in FIGS. 2 and 3 the preferred embodiment of the method for manufacturing strips are illustrated very schematically.
Figure 2:
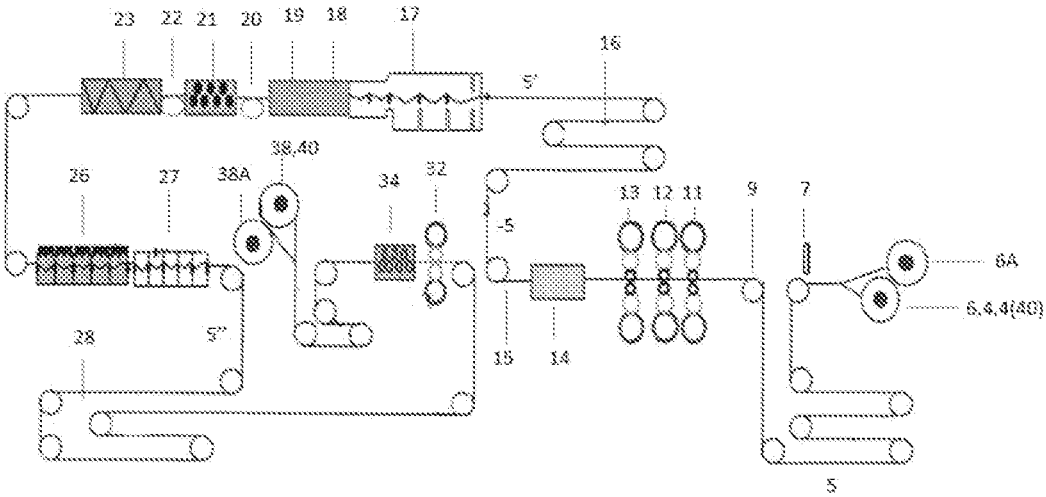
Figure 3:
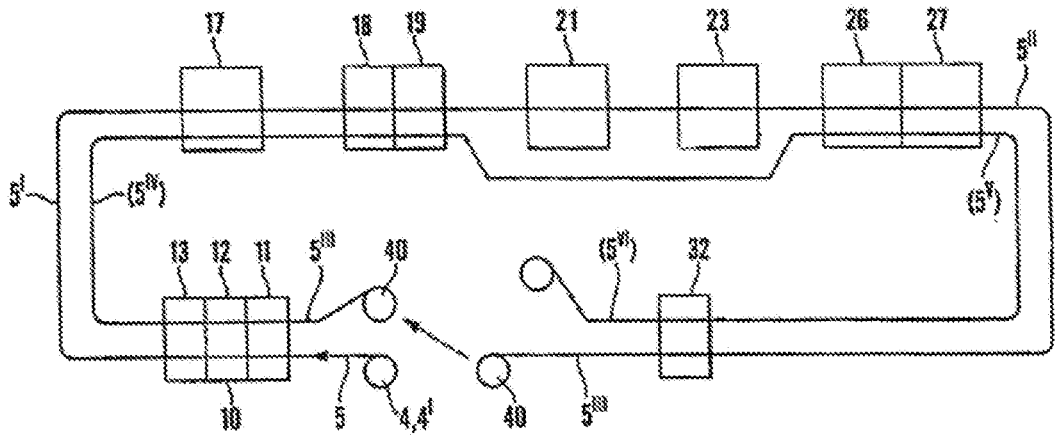

The FIGS. 1-3 schematically illustrate some different methods to manufacture the stainless strips. Preferably the strips of austenitic or ferritic stainless steel constitute starting material for the process in the subsequent rolling mill line (FIG. 2 and FIG. 3), which is used for the carrying out of the method according to the invention. Also ferritic-austenitic steels are conceivable. Three methods of manufacturing the starting material are illustrated in the FIG. 1. According to method I, slabs 1 are hot rolled in a hot rolling mill line for the manufacturing of hot rolled strips with a thickness which can be normal for hot rolled strips, i.e. 1.5-6.5 mm. According to one aspect of the invention, however, the hot rolling is stopped before or at the latest when the thickness has been reduced to 2.5 mm, i.e. so that the strips obtain a thickness within the gauge range 2-6.5 mm, preferably a thickness between 3 and 5 mm. The hot rolled strips are quench-cooled to a temperature lower than 700° C. in a quench-cooling section 3, suitably through intense water-spraying. Thereupon the strips are coiled into coils 4, which are caused to cool further to 100° C. or lower.

According to method II, stainless steel strips are cast to the shape of strips according to any technique which may be known per se and which as far as its specific mode of operation is concerned, does not form part of this invention and will therefore not be described more in detail. By way of example, however, there can be utilised so called stainless steel strip casting by twin rolls, which is a technique known by people skilled in the art. The cast stainless steel strip is hot rolled in a hot rolling mill line 2' to a thickness which is conventional for stainless, hot rolled strips, or somewhat larger, 2-6 mm, see above, whereupon the hot rolled strip immediately is quench-cooled in a cooling section 3 and is coiled to form a coil 4.

According to method III, the stainless steel strip is cast in the shape of a strip having a thickness which is normal for stainless steel strips, or possibly somewhat larger, i.e. about 1.5-6.5 mm, whereupon the strip is quench-cooled in a cooling section 3' to a temperature below 700° C. The thus produced strips are warned up on coils 4'.

The starting material for the subsequent operation in the rolling mill line (FIG. 2 and FIG. 3) thus consists of the cast and/or hot rolled, stainless steel strips 4, 4'. Such a coil 4, 4' of a stainless steel strip is shown in the drawings as it is being decoiled from a decoiler 6. An auxiliary decoiler is designated 6A. A welding machine for splicing strips, a first strip looper, and a first multi-roll S-mill are designated 7, 8, and 9, respectively. Then follows an initial cold rolling section 10, consisting of three cold rolling mills 11, 12, and 13, which mills are of so called Z-high- or 6-high type, which means that each of them has a pair of working rolls and two support rolls over and under respective working roll.

After the initial cold rolling section 10 there follows a degreasing equipment 14, a second multi-roll S-mill 15 and a second strip looper 16.

The strip which has been decoiled from the coil 6 is designated 5. After having passed the initial cold rolling section 10, the strip is designated 5'. From the strip looper 16, the strip 5' is fed through an annealing furnace 7 and a cooling section comprising two cooling chambers 18 and 19. Then there follows a third multi-roll S-mill 20, a descaler 21 and a shot blasting step 23. On each side of descaler 21 there is a fourth and a fifth multi-roll S-mill 20 and 22, respectively. Having, according to the present invention, a descaler before the shot blasting device has the effect of improving flatness in the metal strip and creating primary cracks to enhance the efficiency of the shot blasting step.

The descaler 21 consists of a cold stretch mill, the design of which is shown in detail in FIG. 3 in EP 0 738 781 referred to above, which herein is incorporated in the present description by reference. A cold stretch mill of that type comprises a series of rolls which force the strip to be bent alternatively in different directions, at the same time as the strip is permanently elongated through cold stretching. It has been found that by means of a cold stretch mill of that type it is possible to achieve efficient descaling without impairing the surfaces of the strip beneath the oxide layers.

After the shot blast unit there follows a pickling section, which e.g. can consist of an initial neolyte- or other electrolytic pickling section 26 and a mixed acid pickling section 27. The acid mixture consists of a mixture of nitric acid, $HNO_3$, and hydrofluoric acid, HF and optionally sulphuric acid $H_2SO_4$. The pickled strip, which is designated 5", then can be stored in a third strip looper 28.

A further, terminating cold rolling mill is designated 32. This mill, according to the embodiment, consists of a four-high mill, i.e. a rolling mill with a couple of working rolls and a supporting roll over and under the working roll, respectively, allowing rolling with reductions by up to 15 to 20% depending on the type of stainless steel (austenitic or ferritic, the ferritic steels normally being possible to be rolled with a higher degree of reduction than austenitic steels). Alternatively the finishing cold rolling mill may consist of a two-high mill intended only for skin-pass-rolling. Subsequent to the rolling mill 32 there are provided a sixth multi-roll a straightening mill 34, before the strip 5''' is wound up to form a coil 40 on a coiler 38. An auxiliary coiler has been designated 38A.

According to the various aspects of the invention, the stainless steel strip passes at least once through the rolling mill line in FIG. 2. According to a preferable embodiment, the strip passes twice through the rolling mill line. This will now be disclosed more in detail with reference to FIG. 3 in which only the most essential equipment have been shown, while other parts, such as a welding machine, S-mills, deflecting- and guide rollers, loopers, etc., have been left out in order that the principles of the invention shall be more clear. Reference numerals within brackets indicate strip material that is being processed as the material is passing the rolling mill line B for the second time.

The rolling in the rolling mill line is initiated by unwinding the hot rolled or cast strip 5 of stainless steel from the coil 4, 4' of strip material. It then still has its dark, oxidic coating which it has obtained in the foregoing process in part A. This strip is cold rolled with a thickness reduction of totally at least 10% and max 75% in one, two, or all the three of the rolling mills 11, 12, 13 in the initial cold rolling section 10, preferably with 20-50% area reduction. The comparatively thin, dark oxide layers on the strip surfaces obtained at the quench-cooling after hot rolling or casting are so ductile that they are not broken apart through the cold rolling operations in the initial cold rolling section 10 to such a degree that they get loose from the substrate, i.e. from the metal surface. However, cracks are formed in the oxide layers, i.e. the scales on the steel strips crackle. This appears to be of essential importance for the subsequent pickling, the efficiency of which therein being promoted, which in its turn is important for the achievement of fine surfaces on the final product.

In the annealing furnace 17 the thus cold rolled strip 5' is annealed through heating to a temperature within the temperature range 780-1200 deg. C. depending of the steel grade for so long a period of time that the strip is throughly heated and recrystallised. Furthermore, the grain size model is applied to control the strip the temperature.

In the cooling chambers 19 the strip 5' is cooled to below 100 deg. C., before it is stretch-elongated in the descaler 21 between a plurality of rolls under repeated bending, whereby the oxide scales are broken and good flatness is achieved.

The strip is then shot-blasted in the shot-blasting section 23, which is a second measure for the removal of oxides and scales from the strip surfaces.

The descaling and subsequent shot blasting are preparatory measures to the pickling in the pickling units 26 and 27, where the oxide scales are completely removed.

The surfaces after stretch mill 21 of the strip is shot-blasted in the shot-blasting unit 23 with steel shots, before it is pickled, first through electrolytic pickling in the section 26 and then in mixed acid, a mixture of nitric acid ($HNO_3$), hydrofluoric acid (HF), and optionally sulphuric acid ($H_2SO_4$).

The thus pickled strip 5" then is cold rolled also in the terminating, additional cold rolling mill 32, which is dimensioned such that it can reduce the thickness additionally by up to 20%. Preferably the strip gauge reduction in the finishing cold rolling mill 32 is at least 3% and normally not more than 15%. The strip 5''' then is wound up to form a strip coil 40.

The descaling in the cold-stretch mill 21 can be completely omitted or is the cold stretching performed only to a small degree, about 0.4-2%. However, according to an aspect of the invention also more extended cold-stretching can be conceived, preferably however not more than 3% Thereafter the strip is pickled in the pickling section 26-27 and is finally coiled.

According to an aspect of the invention, the strip is passed one more time through the rolling mill line in the same direction as during the first pass. According to another aspect of the invention, the product from the first pass is the final product.

According to an aspect of the invention the strip coil 40, after a period of time, which depends, among other things, on the logistic planning of the production in the plant, is transported to the decoiler 6 or 6A in the starting position of the rolling mill line, where the strip (5''') again is decoiled for the second passage of the strip through the rolling mill line. While the strip during the first passage possibly only was rolled in one or two of the rolling mills 11-13 in the initial cold rolling section 10, it is this time rolled in two or three of the mills 11-13 so that it essentially achieves the desired final gauge of the strip. The total thickness reduction in the rolling mill section 10 at the second passage of the strip through this section depends on the desired final gauge and can amount to totally 60% and to at least 20%, preferably to at least 30%. After having passed the cold rolling section 10 for the second time, the cold rolling of the strip, now designated ($5^V$), is finished. The final treatment consists of again passing the strip through the annealing furnace 18, the cooling chambers 18 and 19 and the pickling sections 26 and 27. However, it is this time not at all treated in the descaler 21 nor in the shot-blasting unit 23, since the oxidation of the strip surfaces on this occasion will be so insignificant that neither descaling in the cold stretch mill 21 nor blasting in the blasting mill 23 is necessary. The annealed strip therefore can, after cooling, immediately be pickled in the pickling units 26 and 27. The treatment is finished by skin-pass rolling 0.2-1.5%; preferably about 0.5% or by hard rolling 2-20%, preferably 10-15% in the cold rolling mill 32 and/or by straightening through stretching in the straightening mill 34 before final coiling.

The strip ($5^V$), instead of being skin-pass rolled, can be rolled with the same heavy thickness reduction as when the strip was rolled for the first time in the terminating cold rolling mill 32, if the aim is to produce a strip with a very high yield strength.

The above description describes preferred embodiments according to different aspects of methods of using the rolling mill line (FIGS. 2 and 3). It is a particular advantage of the design of the rolling mill line that the rolling mill line or parts of it also can be used for processes which aims at manufacturing not only strips with very fine, bright surfaces but also strips with features which for some applications are of more significant importance than very bright surfaces, such as strips with high strength or strips with a lower degree of improvement but with advantages from a cost point of view. For the latter purpose, the treatment e.g. can be stopped already after the strip 5" has passed the pickling sections 26, 27 after the first passage of the first cold rolling section 10, the annealing and cooling sections, and the pickling sections. When increased strength is desired, 2-20% cold rolling can be done in the terminating cold rolling mill 32, which in that case is performed on non-lubricated surfaces, as the strip passes the terminating cold rolling mill a first time, whereafter the process is finished by coiling the strip.

These examples and alternatives illustrate the versatility and adaptability of the rolling mill line to various wants as far as the final product is concerned.

Example

A slab of stainless austenitic steel of grade ASTM 304 is hot rolled in a Tandem-mill to achieve a strip with a breadth of 1530 mm and a thickness of 6.5 mm. Immediately upon rolling, the strip is quench-cooled from a final rolling temperature of about 900° C. to above 650° C. for about 10 s by water spraying, whereafter the strip is coiled. This concept works with regular hot band cooling since grain boundary carbides can be controlled by annealing and normal scale level pickling under the conditions described above in example.

The strip coil then is transported to the rolling mill line of the invention, is decoiled, and is first cold rolled with its dark oxide layers in two of the rolling mills 11-13 in the initial cold rolling section 10 to the thickness of 3.0 mm, wherein the oxide layers crackle, however without loosening. Thereafter the strip is annealed in the annealing furnace, which has been previously described, at a temperature of 1120° C. for a sufficiently long period of time in order to be completely recrystallised, whereafter the strip is cooled to below 100° C. in the cooling chambers 18 and 19. Then the strip is subjected to descaling in the stretch mill 21, whereafter the surfaces of the strip is shot-blasted in the shot-blasting unit 23 with steel shots, before it is pickled, first through electrolytic pickling in the section 26 and then in mixed acid (mixture of nitric acid, $HNO_3$, hydrofluoric acid, HF and sulphuric acid, $H_2SO_4$) in the pickling section 27. In the finishing cold rolling mill 32 the pickled strip then is cold rolled with a thickness reduction of 10.0% to gauge 2.7 mm, whereafter the strip is wound up on a coil.

The strip then is transported back to the start position. Due to the heavy cold rolling which the strip has been subjected to in the terminating cold rolling operation in the rolling mill 32 it has been deformation hardened to a considerable degree and it is therefore not easily damaged and can therefore be transported and handled without a risk that the strip surfaces shall be damaged. The strip thus again is decoiled and it is this time rolled in all the three rolling mills 11-13 in the initial cold rolling mill 10 with a total thickness reduction of 37% to gauge 1.7 mm. The strip is annealed, cooled, and then pickled in the same way as during the first passage through the rolling mill line but is not shot-blasted or cold stretched prior to pickling according to the example. Finally the strip is skin-pass rolled in the terminating cold roll mill 32, adding a further thickness reduction of about 0.5%, wherein the strip achieves a surface fineness Ra 0.2 μm, i.e. very well corresponding to 2B-surface.

As is apparent from the foregoing, the cold rolling mill of the invention is extremely versatile as far as its use for the manufacturing of stainless strips with very fine surfaces and/or for strips with other desirable qualities or desired features are concerned. In the following table 1 is listed a number of these alternative ways of manufacturing strips with reference to the utilisation of the various thickness reducing units which are included in the rolling mill line, i.e. the initial cold rolling mills, the descaler/cold stretching mill, which also can be used for reducing the thickness of the strip, and the cold rolling mill, or possibly a plurality of cold rolling mills, which terminate the line.

TABLE 1

Alternative ways of manufacturing strips

First passage through the cold rolling line

| Alternative | Cold rolling section 10 | Descaler/cold stretching mill 21 | Cold rolling mill 32 | Achieved surface/next step |
|---|---|---|---|---|
| 1 | Rolling at least one of the mills 10-75%, preferably 20-50% total reduction. | Permanent elongation 0.4-10% | Reduction of thickness 2-15%, preferably 3-10% | Second passage |
| 2 | Ditto | Ditto | — | Ditto |
| 3 | Ditto | Ditto | Hard rolling 2-15% preferably 8-12% | temper rolled, 2B with rough surface |
| 4 | Ditto | Ditto | — | 1E and 2E |

Second passage through the cold rolling line

| Alternative | Cold rolling section 10 | Descaler/cold stretching mill 21 | Cold rolling mill 32 | Achieved surface |
|---|---|---|---|---|
| 1 | Rolling in at least one of the mills 20-65% total reduction | — | Skin-pass rolling 0.2-1.5%, preferably about 0.5 % reduction | 2B |
| 2 | Ditto | — | Ditto | 2B |

The invention claimed is:

1. A method for manufacturing strips of stainless steel, comprising:

hot rolling a strip comprising stainless steel in an initial process, wherein the hot rolling is stopped when the strip thickness has been reduced to a thickness between 2.0 and 6.5 mm, and wherein during the hot rolling, the hot rolled strip is quenched from a final hot rolling temperature to a temperature above 650° C. and below 700° C.; and passing the hot rolled strip through a cold rolling line to produce a cold rolled strip, wherein the cold rolling line comprises, in the following order:

at least one initial cold rolling mill;

at least one annealing section;

a scale breaking section;

a shot blasting section;

at least one pickling section utilizing a mixture of nitric acid $HNO_3$, hydrofluoric acid HF, and optionally sulphuric acid $H_2SO_4$; and at least one terminating cold rolling mill, wherein the hot rolled strip entering the at least one initial cold rolling mill is covered with ductile, dark coloured oxides formed during the hot rolling that substantially remain on the strip after the strip passes through the at least one initial cold rolling mill.

2. The method according to claim 1, wherein as the strip passes through said at least one initial cold rolling mill, the thickness of the hot rolled strip is reduced by 10-60%, and as the strip passes through said at least one terminating cold rolling mill, a thickness of the strip is reduced by 15% or less.

3. The method according to claim 2, wherein as the strip passes through said at least one terminating cold rolling mill, the thickness of the strip is reduced by at least 3% and at most 12%.

4. The method according to claim 3, wherein as the strip passes through said at least one terminating cold rolling mill, the thickness of the strip is reduced by at least 8%.

5. The method according to claim 1, further comprising passing the cold rolled strip through the cold rolling line to produce a twice cold rolled strip.

6. The method according to claim 5, wherein as the cold rolled strip passes through the at least one initial cold rolling mill, a thickness of the cold rolled strip is reduced by 20-60%.

7. The method according to claim 5, wherein as the cold rolled strip passes through the at least one terminating cold rolling mill, the cold rolled strip is skin-pass rolled at a reduction rate of about 0.5%.

8. The method according to claim 5, wherein as the cold rolled strip passes through the at least one terminating cold rolling mill, the cold rolled strip is cold rolled at a reduction rate of 2-15%.

9. The method according to claim 8, wherein as the cold rolled strip passes through the at least one terminating cold rolling mill, the cold rolled strip is cold rolled at a reduction rate of 8-12%.

10. The method of claim 5, wherein when the cold rolled strip is passed through the cold rolling line, the cold rolled strip is not subjected to scale breaking in the scale braking section or shot blasted in the shot blasting section.

* * * * *